United States Patent [19]

Hulot

[11] Patent Number: 4,996,902

[45] Date of Patent: Mar. 5, 1991

[54] MUSICAL INSTRUMENT WITH BARREL

[76] Inventor: Pierre-Marie J. Hulot, 122 Route de Lillers, 62350 Busnes St-Venant, France

[21] Appl. No.: 463,293

[22] Filed: Jan. 10, 1990

[30] Foreign Application Priority Data

Feb. 16, 1989 [FR] France ..... 89 02029

[51] Int. Cl.[5] ..... G10D 7/10

[52] U.S. Cl. ..... 84/390; 84/392

[58] Field of Search ..... 84/390, 392

[56] References Cited

U.S. PATENT DOCUMENTS

| | | | |
|---|---|---|---|
| 105,059 | 7/1870 | Fietz | 84/392 |
| 4,299,156 | 11/1981 | Thayer | 84/390 |
| 4,336,738 | 6/1982 | Alexander | 84/390 |

FOREIGN PATENT DOCUMENTS

| | | | |
|---|---|---|---|
| 559300 | 9/1932 | Fed. Rep. of Germany | 84/392 |
| 424455 | 5/1911 | France | 84/392 |

*Primary Examiner*—Lawrence R. Franklin

*Attorney, Agent, or Firm*—Oliff & Berridge

[57] ABSTRACT

A musical wind instrument, comprising a cylindrical barrel having an inlet hole (3) communicating with the mouthpiece (1) of the instrument, an outlet hole (5) communicating with the bell (12), a branch hole (6), a return hole (7), the branch hole (6) communicating with the return hole (7) via a circuit (13) for changing of tonality, and means (15, 16) for putting of the inlet hole (3) into communication selectively with the outlet hole (5) or with the branch hole (6), wherein the inlet hole (3) and the outlet hole (5) are at different levels along the axis (X,X') of the barrel.

6 Claims, 3 Drawing Sheets

MUSICAL INSTRUMENT WITH BARREL

Figure 1:
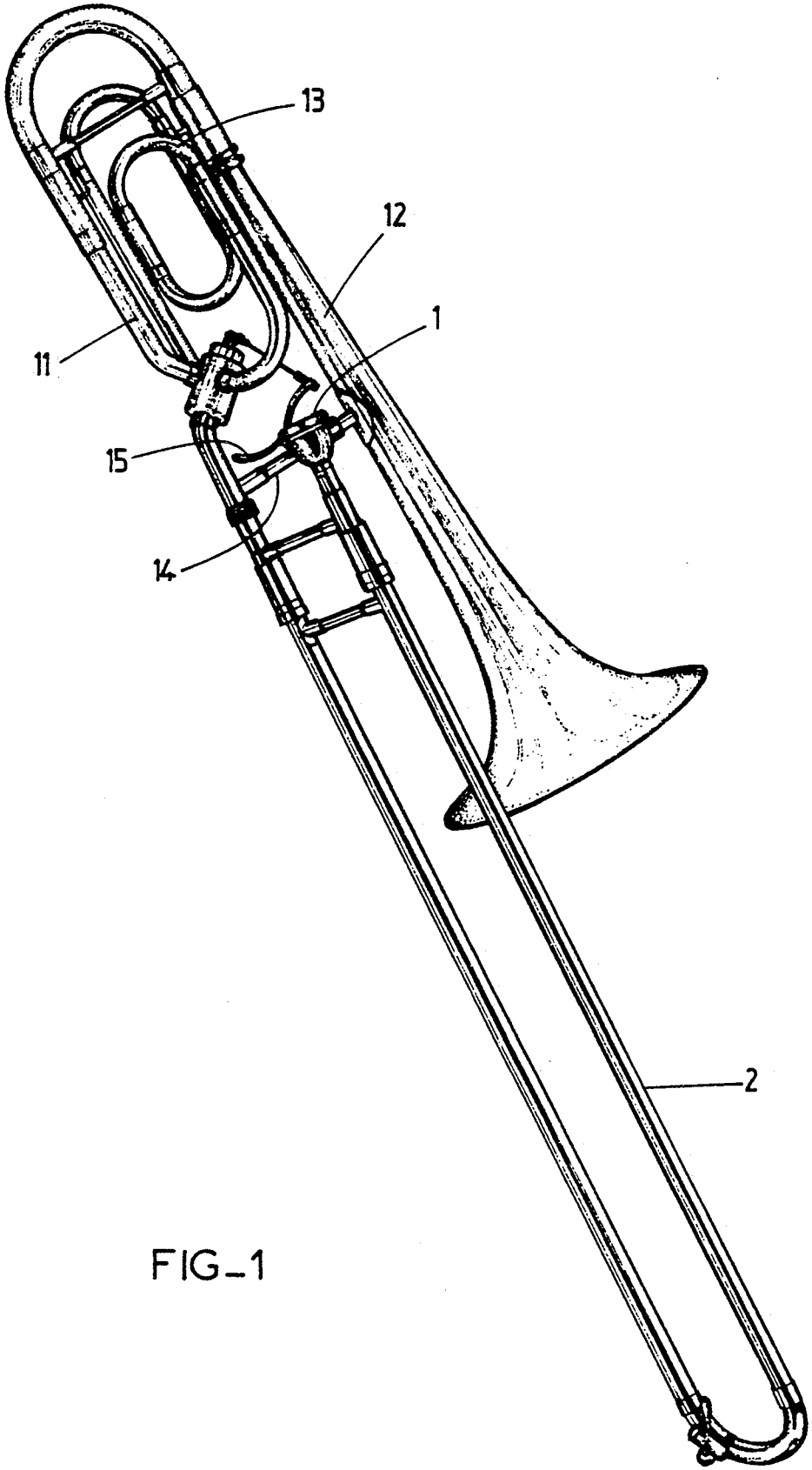

This invention relates to musical wind instruments, the mouthpiece of which communicates with the bell, directly or via a circuit for changing of tonality, by means of a barrel. It relates in particular to brass instruments like the small brass instruments, such as the trumpet, the bugle, the cornet, the French horn, the middle brass instruments such as the tenor saxhorn, the slide trombone, the valve trombone, the large brass instruments, such as the bass saxhorn, the contrabass saxhorn, the tuba, the contratuba, the helicon, the soubassophone, the bass trombone, the contrabass trombone, and also drum-and-bugle band instruments, such as bugle-trumpets, trumpet-bugles.

An instrument of this type is already known, with a cylindrical barrel having an inlet hole communicating with the mouthpiece of the instrument, an outlet hole communicating with the bell of the instrument, a branch hole and a return hole. The branch hole communicates with the return hole via a circuit for changing of tonality. Means are provided in order selectively to make the inlet hole communicate with the outlet hole which is in its extension or with the branch hole, the air being displaced in this case in the barrel through two 90° angles. This results in a considerable pressure drop very different from that which is produced when the air passes in a straight line from the inlet hole to the outlet hole. The instrumentalist has to correct this variation by blowing harder. It is very difficult for him to determine precisely the extra blowing power to compensate for the pressure drop when changing register.

The invention alleviates this disadvantage through a musical instrument which facilitates the emission, so that the instrumentalist can play more correctly with less effort.

The invention therefore relates to a musical instrument of the type indicated above, in which the inlet hole and the outlet hole are made at different levels along the axis of the barrel. Owing to the distance which is thus available between the two holes, the aperture in the rotor putting them into communication may be given a gentle curvature, substantially equivalent for the emission to a straight line passage from the inlet hole to the outlet hole. This characteristic also enables the inlet hole and the branch hole to be arranged at different levels along the axis of the barrel and to make use of the same aperture of the rotor in order to supply from the inlet hole selectively the outlet hole or the branch hole, particularly when the outlet hole and the branch hole are symmetrically arranged with respect to the inlet hole. In this case the emission is exactly the same, whatever the register.

According to a preferred embodiment, the inlet hole is made in one of the frontal faces of the cylindrical barrel and, preferably, is axial. The best results are obtained when the outlet hole and the branch hole, and also, as need be, the return hole, are further away from the frontal face in which the inlet hole is made than from the opposite frontal face. Advantageously the outlet hole, the branch hole and optionally also the return hole are at the same level along the axis of the barrel, being preferably radial holes.

The invention relates especially to a musical wind instrument the mouthpiece of which communicates with the bell directly or via a circuit for changing of tonality by means of a barrel formed of a cylindrical shell having one inlet hole communicating with the mouthpiece, one outlet hole between which is mounted the circuit for changing of tonality, of a cylindrical rotor mounted so as to turn in the shell about its axis, in one of the hemicylindrical halves of which is made a first aperture substantially traverse to the axis of the rotor and in the other hemicylindrical half, diametrically opposed to the first, of which is made a second aperture one of the end of which opens onto the lateral face of the rotor in a direction substantially perpendicular to the axis, and of mechanism adapted to cause the rotor to turn about its axis with respect to the shell so as to put the inlet hole selectively into communication with the outlet hole or with the branch hole via the second aperture. According to the invention, the inlet hole is axial and opens onto one frontal face of the shell and the outlet and branch, and preferably return, holes are radial, the other end of the second aperture opening onto one of the frontal faces of the rotor.

Preferably, the branch hole and the return hole are arranged symmetrically with respect to the outlet hole.

Figure 2:
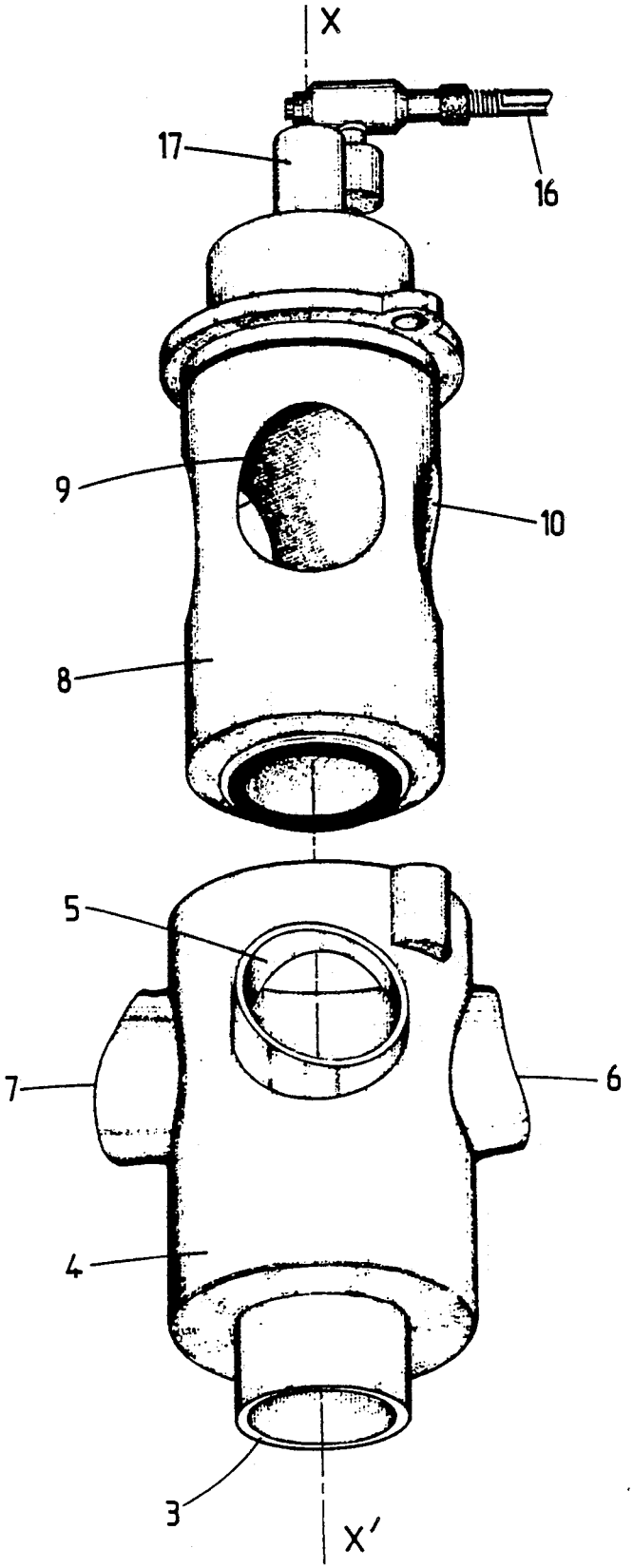
Figure 3:
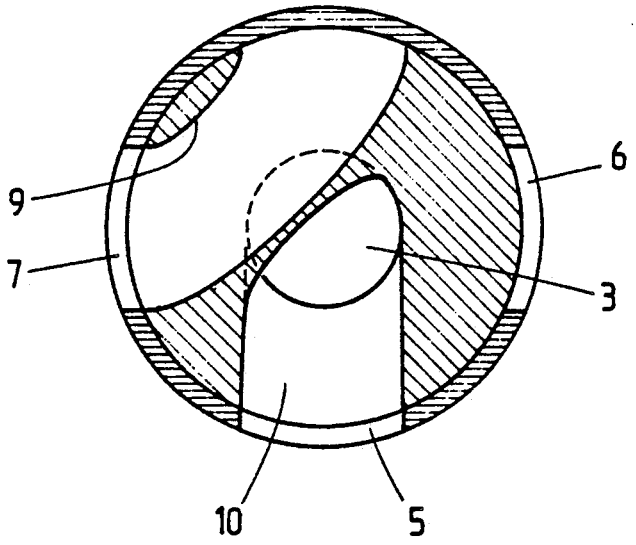
Figure 4:
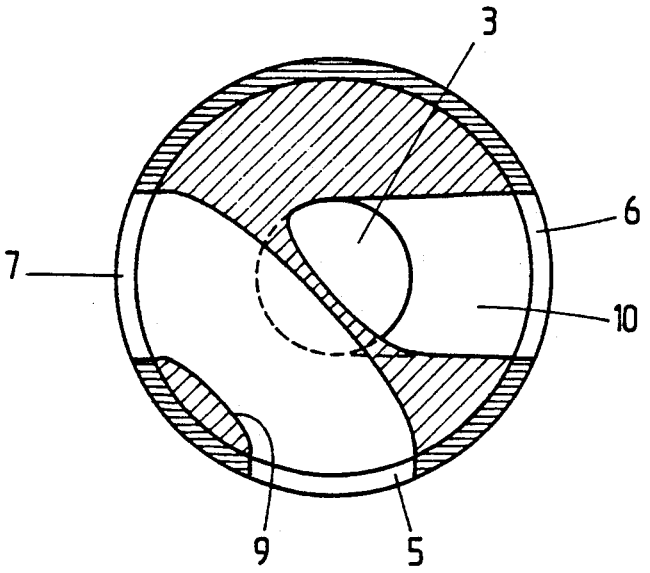

In the attached drawings, given solely by way of example:

FIG. 1 is a partial perspective view of a trombone according to the invention, FIG. 2 is an exploded view of the barrel of the trombone of FIG. 1, FIG. 3 is a sectional view along line I.I of FIG. 2, when the inlet hole is communicating with the outlet hole, and FIG. 4 is a view similar to FIG. 3, when the inlet hole is communicating with the branch hole.

The trombone shown in FIG. 1 comprises a mouthpiece 1 which the instrumentalist puts to his mouth and which is extended by a bent tube 2 termed slide opening into the axial inlet hole 3 of the cylindrical shell 4 of a barrel. The shell of the barrel also comprises an outlet hole 5, a branch hole 6 and a return hole 7. These three holes 5, 6 and 7 are radial and are, in the same transverse plane, farther away from the frontal face into which the inlet hole 3 opens than from the opposite frontal face.

In the barrel is rotatably mounted a cylindrical rotor 8 comprising in one hemicylindrical half an aperture 9 substantially transverse to the axis X, X' of the rotor and an aperture 10 one of the ends of which opens along an axial orifice into one of the lateral faces of the rotor and the other end of which opens along a radial orifice onto the lateral face of the rotor.

The outlet hole 5 communicates via a tube 11 with the bell 12. The branch hole 6 communicates via a circuit 13 for changing of tonality with the return hole 7. The tube 2 and the tube 1 are connected by a crosspiece 14 onto which is mounted so as to rock a lever or a plate 15 connected to a crank 16 operating an axial pivot 17 of the rotor and thus causing it to be turned through a quarter of a revolution.

In FIG. 3, the inlet hole 3 communicates via the aperture 10 with the outlet hole 5, In FIG. 4, the rotor has turned through 90°. The inlet hole 3 communicates with the branch hole 6 via the aperture 10, whereas the return hole 7 communicates with the outlet hole 5 via the aperture 9.

I claim:

The path followed by the air to pass from the inlet hole 3 to the outlet hole 5 or to the branch hole 6 is precisely the same in length and in curvature. This curvature is accordingly less pronounced the farther away the holes 5 and 6 are from the frontal face of the shell into which the inlet hole 3 opens, than from the opposite frontal face.

1. A musical wind instrument, comprising a mouthpiece, a bell, a cylindrical barrel with axis and with axial inlet hole communicating with the mouthpiece, a radial outlet hole communicating with the bell, a radial branch hole, a radial return hole, the branch hole communicating with the return hole via a circuit for changing of tonality and means for putting the inlet hole into communication selectively with the outlet hole or with the branch hole.

2. The instrument as claimed in claim 1, wherein the branch hole and the return hole are symmetrically arranged with respect to the outlet hole.

3. The instrument as claimed in claim 1, wherein the outlet hole and the branch hole are symmetrically arranged with respect to the inlet hole.

4. The instrument as claimed in claim 1, wherein the barrel has two frontal faces, the inlet hole opens onto one of the frontal faces of the barrel and at least one of the outlet hole, the branch hole and the return hole is farther away from the frontal face into which the inlet hole opens than from the other frontal face of the barrel.

5. The musical wind instrument of claim 1, wherein said barrel comprises a cylindrical shell with a frontal face, an inlet hole communicating with the mouthpiece, a radial outlet hole communicating with the bell, a radial branch hole and a radial return hole, wherein a circuit for changing tonality is mounted between the branch hole and the return hole, a cylindrical rotor with an axis, a lateral face, and a frontal face, wherein a first aperture is provided substantially transverse to the axis of the rotor, and a second aperture is provided, wherein a first end of the second aperture opens onto the lateral face of the rotor in a direction substantially perpendicular to the axis, said second aperture first end being diametrically opposed to one of the ends of the first aperture, and a mechanism for turning the rotor about its axis with respect to the shell so as to put the inlet hole into communication selectively with the outlet hole or with the branch hole via the second aperture, wherein the inlet hole is axial and is provided in the frontal face of the shell and the other end of the second aperture is axial and opens onto the frontal face of the rotor.

6. The musical wind instrument of claim 1, wherein said barrel comprises a cylindrical shell with a frontal face, an inlet hole communicating with the mouthpiece, a radial outlet hole communicating with the bell, a radial branch hole and a radial return hole, a cylindrical rotor with an axis, a lateral face, and a frontal face, wherein a first aperture is provided substantially transverse to the axis of the rotor, and a second aperture is provided, wherein an end of the second aperture opens onto the lateral face of the rotor in a direction substantially perpendicular to the axis, said second aperture end being diametrically opposed to one of the ends of the first aperture, and a mechanism for turning the rotor about its axis with respect to the shell so as to put the inlet hole into communication selectively with the outlet hole or with the branch hole via the second aperture, wherein the inlet hole is axial and is provided in the frontal face of the shell and the other end of the second aperture is axial and opens onto the frontal face of the rotor.

* * * * *